US005400813A

United States Patent [19]

Swan, Jr.

[11] Patent Number: 5,400,813

[45] Date of Patent: Mar. 28, 1995

[54] AWNING FOR RECREATIONAL VEHICLES

[76] Inventor: Ronald L. Swan, Jr., 817 Venderbilt Ave., Virginia Beach, Va. 23451

[21] Appl. No.: 801,928

[22] Filed: Dec. 3, 1991

[51] Int. Cl.[6] ..... E04H 15/06

[52] U.S. Cl. ..... 135/88.07; 135/119; 296/163

[58] Field of Search ..... 135/88, 89, 90, 108, 135/115, 117, 119; 160/45, 46; 296/163; 24/599.8, 601.4

[56] References Cited

U.S. PATENT DOCUMENTS

| | | | |
|---|---|---|---|
| 731,162 | 6/1903 | Carter | 24/599.8 X |
| 2,333,488 | 11/1943 | Parth | 24/599.8 X |
| 2,720,885 | 10/1955 | Legg | 135/89 X |
| 2,859,756 | 11/1958 | Barnes . | |
| 3,800,814 | 4/1974 | Hibbert | 135/119 X |
| 3,825,092 | 7/1974 | Graydon et al. | 24/601.4 X |
| 3,923,336 | 12/1975 | Price, Sr. . | |
| 3,970,096 | 7/1976 | Nicolai | 135/115 X |
| 3,980,121 | 9/1976 | McKee . | |
| 4,013,314 | 3/1977 | Archer | 24/599.8 X |
| 4,171,013 | 10/1979 | Clark . | |
| 4,191,418 | 3/1980 | Ladegast, Jr. . | |
| 4,440,432 | 4/1984 | Goris | 24/599.8 X |
| 4,537,210 | 8/1985 | Montgomery | 135/115 X |
| 4,754,774 | 7/1988 | Leader . | |
| 4,827,958 | 5/1989 | Cantwell et al. | 135/119 X |
| 4,901,745 | 2/1990 | Rice . | |

*Primary Examiner*—Lanna Mai

*Attorney, Agent, or Firm*—James Creighton Wray

[57] ABSTRACT

An awning which is universally adaptable to nearly all passenger vehicles, as well as recreational vehicles, is disclosed. A tarp is connected through roof tethers, either to a roof rack or vehicle gutter at one end, and is supported by support poles and tethers and anchored to the ground at the other end. The support poles are collapsible, and the tarp is made of a relatively light-weight material. The tethers are long and short and have loops and spring snap hooks or gutter clamps at opposite ends for quick attachment to the tarp and ground supports and to an automobile roof rack or gutter. The tarp, collapsed poles and tethers are self-contained within a stuff sack for easy portability.

3 Claims, 2 Drawing Sheets

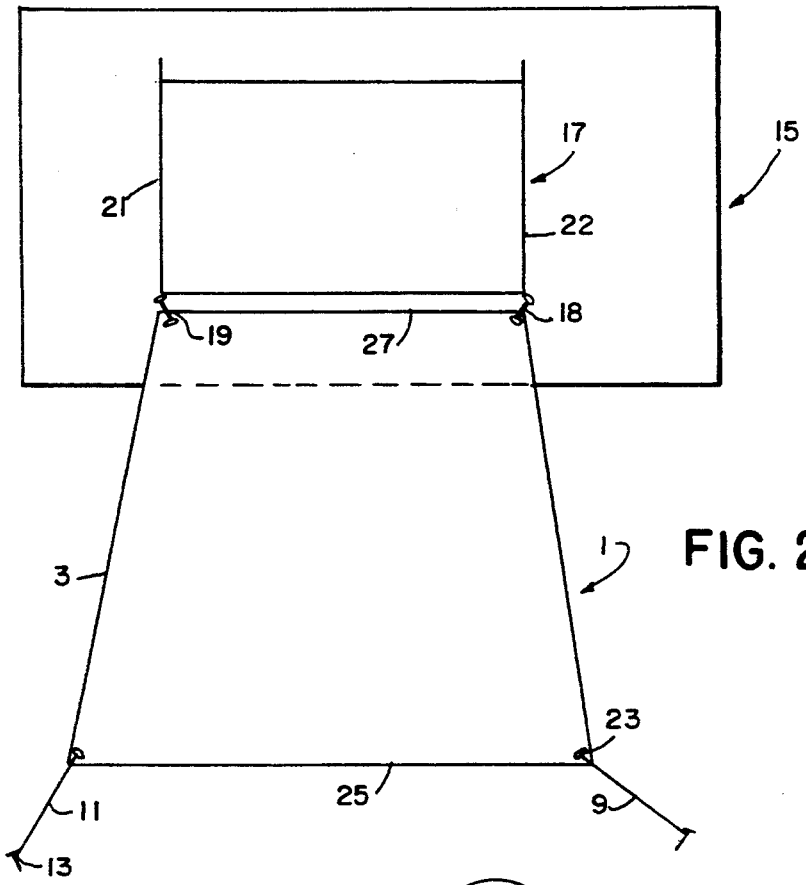
FIG. 2
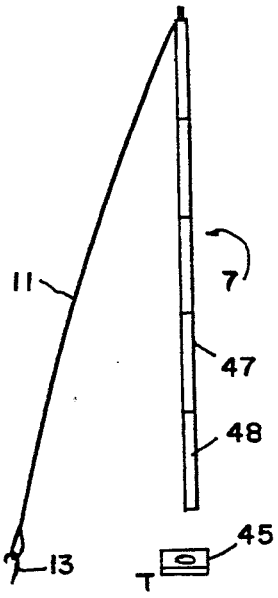
FIG. 7
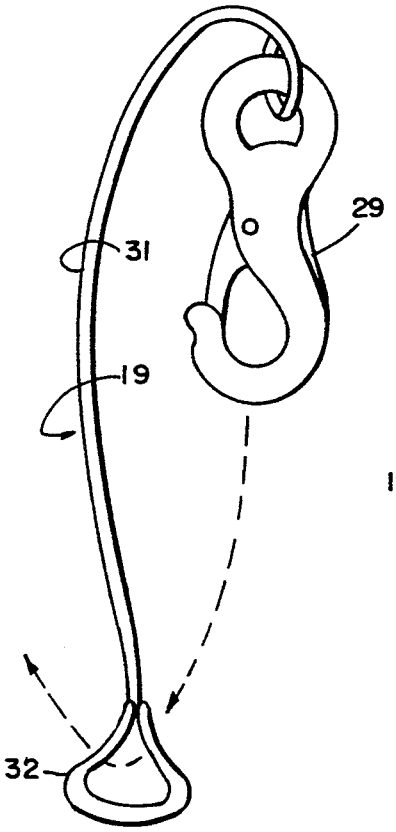
FIG. 8
FIG. 9
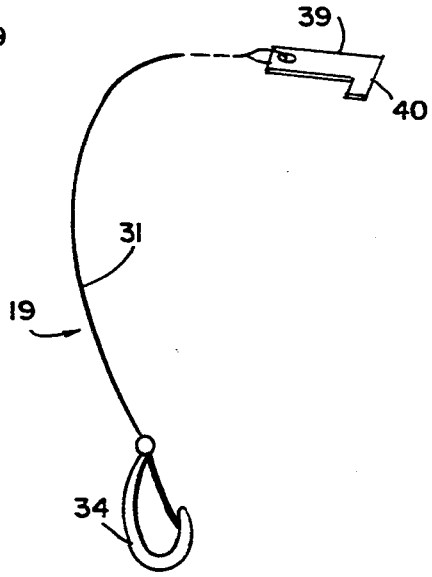

AWNING FOR RECREATIONAL VEHICLES

BACKGROUND OF THE INVENTION

Awnings for recreational vehicles,-particularly camper-type recreational vehicles, are common and are used on outings by campers, picnickers, hikers, etc. Most of those awnings are attached or attachable to sides of vehicles, and are typically contained cylindrical housings, wherein the tarp is wound within the housing and is unwound and anchored opposite the vehicle when in use. The housings are necessarily bulky, due to the winding apparatus and space needed within the housing, as well as the extra bulk provided by the housing itself. Further, exterior support or tent poles needed for exterior support are typically lost because they are not included within the housing package. Further, the structures, because the mechanisms employed, break down, are complicated to assemble and are expensive to manufacture.

There exists a need for awnings that are universal for nearly all passenger vehicles, and recreational vehicles, which are of simple construction and can thus be manufactured cheaply, which can be assembled easily and have no mechanical parts to malfunction, and which can be self-contained within a relatively small package for portability without taking valuable space on outings.

SUMMARY OF THE INVENTION

The present invention provides an awning for recreational vehicles which is portable, inexpensive to manufacture, and can be erected with a minimal amount of difficulty. The basic invention incorporates a single tarp made of canvas or synthetic material, preferably water-repellant or treated with water repellents, and two support poles. The tarp is anchored to the roof of a vehicle and extends either from the side of the vehicle or from the rear of the vehicle outwards, and is supported by the support poles at its opposite or extension end. The support poles are preferably approximately the same height as the vehicle, and tether lines attached to the tarp near the juncture with the support poles against the vehicle anchorage, causing the tarp to be pulled tightly over the upright support poles and thus providing shelter to the user. The extension side tether can be anchored to the ground with tent pegs, or tied to a tree or any other solid structure opposite the vehicle attachment. The vehicle anchors are preferably short tethers attached to the corners of the tarp. The tether ends opposite the tarp vehicle attachment are provided with snap links or clips for attachment to the luggage rack or gutter anchors for attachment to gutters of the vehicle. The support poles are collapsible and are made of sturdy lightweight material such as aluminum, fiberglass or plastic. Plural fitted sections make up a support pole, and an elastic band can be run through hollow centers of the sections to allow collapsing of the poles and to ensure proper fitting of the respective sections of each support pole and prevent loss of one of the sections. Support pole pads can be provided at the bottom of the poles to distribute the weight of the pole on the ground, disallowing "digging in" of the thin poles.

Various embodiments of tethers are provided in the present invention. In one embodiment, the vehicle attachment tether provides a gutter anchor at one end and a snap clip at the other end. Another embodiment provides a loop at one end of the tether and a snap clip at the other end. The loop is slipped through an aperture at one corner of the vehicle attachment side of the tarp, and the snap link is then slipped through the loop to attach the tether to the tarp corner. The snap link is then hooked to a rung of a luggage rack.

The present invention also provides a stuff sack or similar carrying article for accommodating the disassembled awning. The sections of the support poles easily fit lengthwise in the stuff sack, and the tarp is either rolled and placed into the sack with the poles, or simply stuffed in the sack beside the poles. In either case, the simple construction with limited numbers of components allows the stuff sack to be small in length and diameter.

In another embodiment, the support poles are telescopic, simplifying assembly and disassembly of the structure further.

The awning is self-contained, portable and attaches universally to nearly all passenger vehicles, and particularly recreational vehicles, by hooks, fasteners and/or clips to be attached rain gutters and/or roof racks. The awning can extend either from the side or rear of the vehicle and thus covers entrance to side doors or to the rear hatch.

A preferred vehicle awning is a tarp having a vehicle attachment end and an extension end. The vehicle attachment end incorporates vehicle anchors extending from the end for attachment of the tarp to the vehicle. Plural support poles are provided for supporting the extension ends. Respective extension tethers are provided adjacent the support poles for anchoring the tarp opposite the vehicle anchors, holding the support poles upright and stretching the tarp between the vehicle anchors and the support poles.

The preferred awning further has plural tethers with first and second ends. The first ends are attached to the vehicle attachment side of the tarp, and the second ends are provided with roof anchors for attachment of the tethers to the roof of a vehicle and anchoring the vehicle side to the roof of a vehicle.

The awning further includes plural fittings provided in the extension side of the tarp for fitting respective support poles. The support poles are fitted into the fittings and are held therein for supporting the extension side of the tarp. The adjacent extension side tethers pull opposite the vehicle attachment for holding the support poles upright.

The preferred support poles are cylindrical tubes, and each tube has fitted segments detachable from one another for portability. Preferably the cylindrical tubes are aluminum structures. In one embodiment, the tubes are of fiberglass or plastic construction.

Preferably the tarp has a rectangular shape with four corners. The vehicle attachment means are first and second tethers attached to first and second respective corners of the vehicle attachment side of the tarp, and roof anchors are provided opposite the tarp attachments on the tethers. First and second support poles fit within first and second support pole fittings proximal first and second extension side corners opposite the vehicle side attachments. First and second respective extension side tethers are attached to first and second extension corners for anchoring the extension side to the ground and holding the support poles upright.

The preferred portable vehicle awning comprises a tarp having a vehicle attachment side and an extension side. The vehicle extension side is provided with plural vehicle attachment tethers and with fittings for support poles. The support poles approximate the height of the vehicle, vehicle attachment means attaching proximal the roof of the vehicle. Extension tethers are provided on the extension side for anchoring the extension side opposite the vehicle attachment and holding the support poles upright, the support poles being collapsible. A stuff bag is provided for carrying the collapsed awning.

The present invention is simple in construction, stores easily in a tote bag and is universal in its attachment to vehicles without special fittings.

These and further and other objects and features of the invention are apparent in the disclosure, which includes the above and ongoing written specification, with the claims and the drawings.

BRIEF DESCRIPTION OF THE DRAWINGS

FIG. 2 is a top view of the preferred awning showing connection to a vehicle roof and extended ground tethers.

FIG. 7 shows the awning support pole and ground tether combination.

FIG. 8 shows a preferred roof connector with a snap clip.

FIG. 9 shows an alternate roof connector having a gutter engagement means and an opposite snap clip.

DETAILED DESCRIPTION OF THE DRAWINGS

Figure 1:
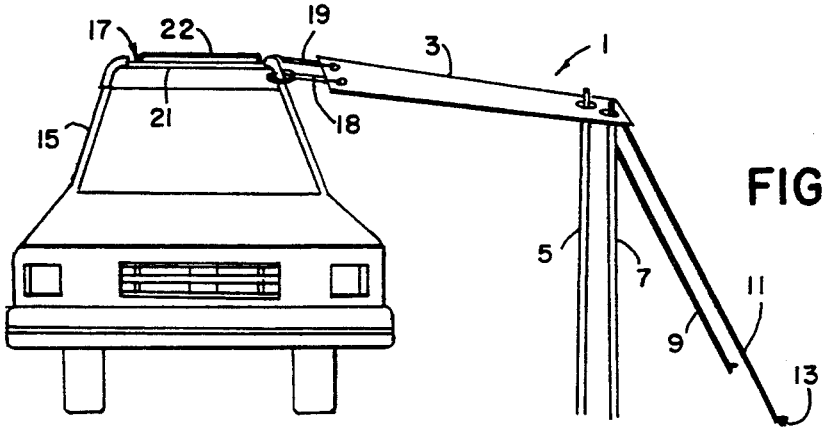
FIG. 1 is a side view of a preferred awning attached to a vehicle.

Referring to FIG. 1, the awning of the present invention is generally referred to by the numeral 1. The awning 1 has a tarp 3 and support poles 5 and 7, with adjacent tether lines 9 and 11, which anchor the awning 1 to the ground. Preferably the tether lines 9 and 11 are anchored with pegs 13, but as is common with similar structures, the tethers can be anchored around trees, rocks or other solid structures.

The tarp is oppositely fixed to an automobile, preferably at or near the roof of the automobile so as to provide sufficient height underneath and access into and out of the vehicle through the doors. The vehicle 15 in FIG. 1 is provided with a luggage rack 17 to which the tarp 3 is connected through vehicle attachments 18 and 19, with snap hooks which engage respective struts 21 and 22 of the luggage rack 17.

FIG. 2 is a top view of the awning and vehicle. The tarp 3 is trapezoidal in shape, but alternate embodiments provide rectangles, squares or other appropriate shapes extending from the roof and supported by the poles. In its preferred embodiment, the tarp 3 incorporates support pole attachment apertures 23, through which one end of the support pole protrudes. At or adjacent the aperture 23, the tether 9 attaches to pull against the vehicle attachments 18 and 19 over the support pole (not shown) to make the tarp taut.

Alternative embodiments provide pockets or sleeves for insertion of the pole ends into the tarp and snap hooks on the ends of the tethers for attaching to edges of the tarp. The tarp has an extension side 25 anchored and supported by the tethers 9 and 11 and the support poles. Opposite the extension side 25 is the vehicle attachment side 27, which incorporates first and second vehicle attachment means 18 and 19. The attachment means 18 and 19 are preferably flexible lines which connect with loops to reinforced holes in corners of the vehicle attachment side 27 and which extend outward for attachment at or near the roof of the vehicle.

Figure 3:
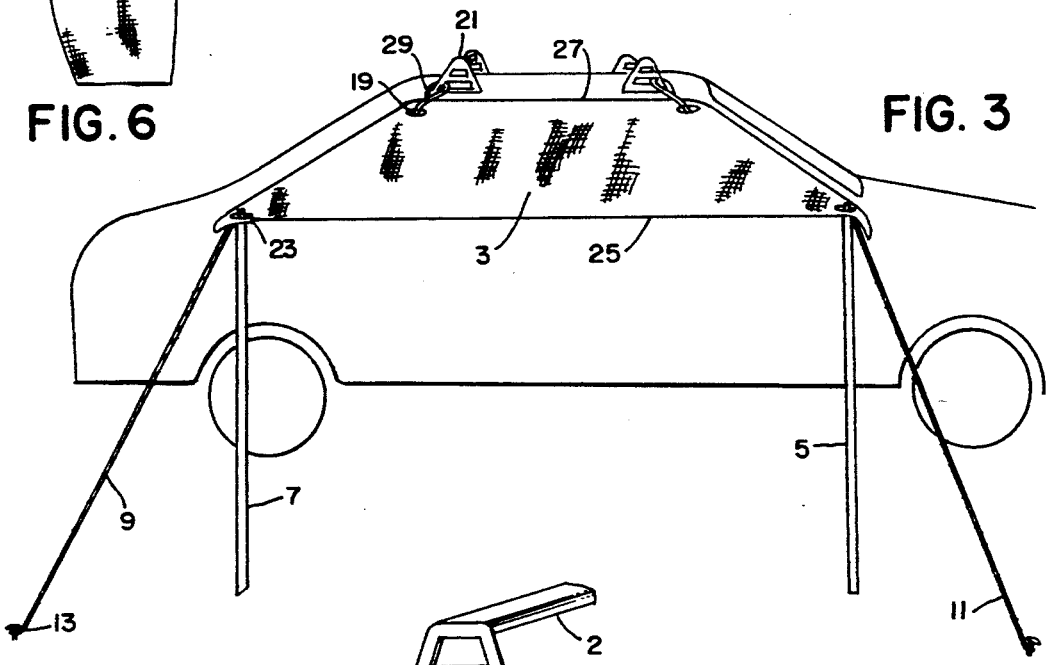
FIG. 3 is a front view of the preferred awning in the assembled position.

FIG. 3 shows the awning from a frontal view, wherein the tarp is attached to a luggage rack by vehicle attachment means 19, which incorporate spring hook clips 29 which easily attach to the respective rungs 21 of the rack. As shown, the front edge 25 of the tarp 3 is supported by tent poles and 5 and 7, and the tarp is pulled taut by tethers 9 and 11.

Figure 4:
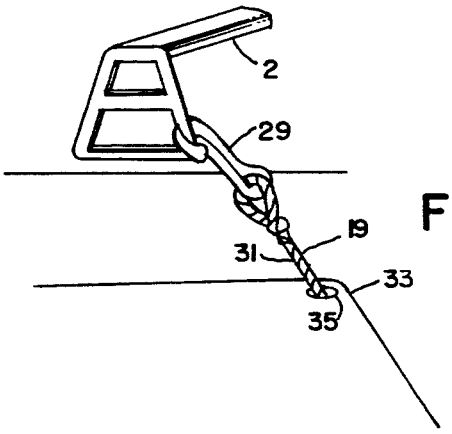
FIG. 4 is a sectional view showing connection of one corner of the awning to a luggage rack.

FIG. 4 shows the vehicle attachment means 19, incorporating a vehicle side tether 31 and clip 29. The tether 31 is attached to the corner 33 of the tarp by threading through an aperture 35 or by other suitable means. The clip 29 is preferably made of metal, plastic or other suitable material strong enough to withstand the stresses of anchoring the tarp to the vehicle.

Figure 5:
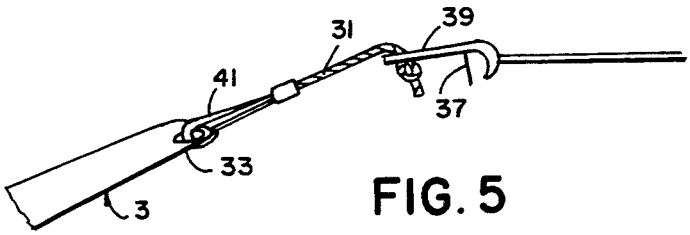
FIG. 5 is a side view showing an alternate vehicle connection means, wherein the awning connects to a roof gutter.

FIG. 5 shows an alternate means for anchoring the tarp to the vehicle, wherein the vehicle's roof gutter 37 is employed instead of the luggage rack. An angular roof anchor 39 is attached to the tether 31, which attaches with a loop to a reinforced hole in the corner 33 of the tarp 3. In this case, a corner attachment clip 41 attaches the tether to the tarp.

Figure 6:
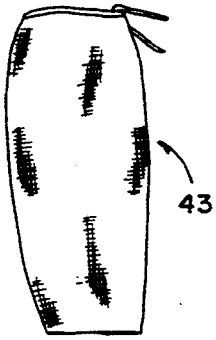
FIG. 6 shows a tote bag for packaging the awning during non-use.

In its preferred embodiment, the present vehicle awning can be rolled or stuffed into a stuff sack 43, as shown in FIG. 6, for portability.

FIG. 7 shows the support pole 7 and attached tether 11 apparatus. The anchor or tent peg 13 is forced into the ground to hold the support pole upright. In a preferred embodiment, a support pad 45 is provided to distribute the weight of the support pole 7. The support pole 7 divides into sections 47 and 48 for portability. Support pad is to be of at least 1" in thickness with a $\frac{1}{2}$" insert for support pole. Support pad to have plastic or metal spikes on bottom to secure pad into ground.

FIGS. 8 and 9 shows two embodiments of roof anchors. FIG. 8 shows the tether 31 having a loop 32 on one end, and a snap link clip 29 on its opposite end. The loop slides through the aperture (not shown) on the corner of the tarp, and the snap link 29 slides through the loop, thus anchoring the tether to the tarp. The snap link 29 is then fastened to the vehicle on the luggage rack or other suitable sites.

FIG. 9 shows the anchor 19 with tether 31. The tether incorporates a tarp clip 34 which clips to the tarp, and a gutter anchor 39 which is inserted into the gutter and held by a protrusion 40.

The tarp of the present invention is preferably made of a synthetic, water-repellant material or canvas. However, other suitable materials are not beyond the scope of the invention. The tarp can vary in shape or style, with the cut adjusted to the needs of the user. The support poles are preferably made of a sturdy, lightweight material such as aluminum, and are segmented for folding and stuffing with the tarp and anchor tether into a stuff bag for portability. The preferred awning attaches universally to all four-wheeled passenger vehicles, and particularly to recreational vehicles. Preferred fasteners to the vehicle include gutter hooks and snap links. The tarp preferably extends from the side or rear of the vehicle, and is supported oppositely by plural support poles and is anchored oppositely to the ground or other structure by a tether fastened to the tarp near the support poles. The height of the poles is preferably similar in height to the vehicle. Segmented poles allow for adjustability to suit vehicles having different roof heights.

A primary object of the present invention is to provide a vehicle awning which is self-containable, portable within a stuff bag, and preferably no heavier than a typical tent. The structure is simple and novel in design, and can be made relatively inexpensively, because of the relatively few numbers of parts.

It is a further object of the present invention to provide an awning for vehicles which is universally adaptable, which can be attached to the side or rear of a vehicle, anchoring to a luggage rack or gutter, and which takes only minutes to assemble.

While the invention has been described with reference to specific embodiments, modifications and variations of the invention may be constructed without departing from the scope of the invention, which is defined in the following claims.

I claim:

1. A portable vehicle awning comprising a tarp having a vehicle attachment side and an extension side, said vehicle attachment side being provided with plural vehicle attachment tethers and said extension side provided with fittings for support poles, said support poles approximating the height of the vehicle, vehicle attachment means attaching proximal the roof of the vehicle, extension tethers provided on the extension side for anchoring the extension side opposite the vehicle attachment and holding the support poles upright, said support poles being collapsible; and a stuff bag provided for carrying the collapsed awning, wherein the vehicle attachment tethers comprise lines with loops at first ends for fastening the attachment tethers through openings in the tarp, wherein the lines have spring link snap clips at second ends for attaching to a vehicle roof rack.

2. A portable vehicle awning comprising a tarp having a vehicle attachment side and an extension side, said vehicle attachment side being provided with plural vehicle attachment tethers and said extension side provided with fittings for support poles, said support poles approximating the height of the vehicle, vehicle attachment means attaching proximal the roof of the vehicle, extension tethers provided on the extension side for anchoring the extension side opposite the vehicle attachment and holding the support poles upright, said support poles being collapsible; and a stuff bag provided for carrying the collapsed awning, wherein the vehicle attachment tethers comprise lines with loops at first ends for fastening the attachment tethers through openings in the tarp, wherein the lines have spring link snap clips at second ends for attaching to a vehicle roof rack, and roof gutter clamps at second ends for attaching to a vehicle roof gutter.

3. A vehicle sports awning kit, comprising a tarp having plural grommets at plural corners and having support pole end receivers along one side edge, the tarp being collapsible by folding or rolling for fitting in the stuff sack, first and second collapsible support poles having upper ends for fitting in the receivers and having lower ends and being collapsible for sliding in the stuff sack by the tarp, first and second relatively long ground support extension tethers having spring link snap clips at one end and loops at the other ends, and wherein the tethers are slightly longer than the pole, and first and second relatively short vehicle attachment tethers, all of the tethers fitting with the collapsed tarp and the collapsed poles in the stuff sack, wherein the vehicle attachment tethers comprise lines with loops at first ends for fastening the attachment tethers through openings in the tarp, and wherein the lines have spring link snap clips at second ends for attaching to a vehicle roof rack.

* * * * *